United States Patent [19]

Deutsch

[11] Patent Number: 4,515,058

[45] Date of Patent: May 7, 1985

[54] ADAPTIVE TONE GENERATOR ASSIGNMENT IN A KEYBOARD ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 574,440

[22] Filed: Jan. 27, 1984

[51] Int. Cl.[3] ..... G10H 1/02

[52] U.S. Cl. ..... 84/1.24; 84/1.03; 84/1.26

[58] Field of Search ..... 84/1.24, 1.03, 1.01, 84/1.26, 1.13

[56] References Cited

U.S. PATENT DOCUMENTS 4,152,966 5/1979 Deutsch ..... 84/1.24

4,191,081 3/1980 Deutsch et al. ..... 84/1.24

4,354,414 10/1982 Deutsch et al. ..... 84/1.24

*Primary Examiner*—Forester W. Isen

*Attorney, Agent, or Firm*—Ralph Deutsch

[57] ABSTRACT

A keyboard operated electronic musical instrument is disclosed in which a first set of tone generators is assigned to actuated keyswitches on a first keyboard and a second set of tone generators is nominally assigned to actuated keyswitches on a second keyboard. Assignment logic is provided so that when all the members of the first set of tone generators have been assigned an addition keyswitch actuation causes the temporary borrowing of one of the tone generators in the second set to respond to the newly actuated keyswitch. Saturation of tone generator assignment is diminished by a glissando detect subsystem which inhibits the use of a long release envelope release phase if a glissando has been initiated.

9 Claims, 3 Drawing Figures

ADAPTIVE TONE GENERATOR ASSIGNMENT IN A KEYBOARD ELECTRONIC MUSICAL INSTRUMENT

BACKGROUND OF THE INVENTION

1. Field of the Invention

This invention relates to electronic music synthesis and in particular is concerned with the assignment of a limited number of tone generators to actuated keyboard switches.

2. Description of the Prior Art

The current trend to use microelectronic implemented tone generators for keyboard operated musical instruments has led to the development of systems which achieve a measure of economy by using a plurality of tone generators which is less in number than the number of keyboard switches in the keyboard array of keyswitches. An assignment logic is implemented to assign the members of the available tone generators to keyswitches as they are depressed to their actuated keyswitch states. An inevitable resource availaility problem arises when all the tone generators have been assigned to keyswitches and an additional keyswitch is actuated.

One of the earliest assignment systems was disclosed in U.S. Pat. No. 2,577,493 entitled "Electronic Musical Instrument." In the disclosed system a number of analog oscillators are assigned by means of a multicontact set of keyswitch contacts to actuated keyswitches. The assignment action also introduces a preselected capacitor so that the assigned oscillator generates a signal whose fundamental frequency corresponds to the assigned actuated keyswitch. The assignment system disclosed in the referenced patent does not teach any means to cope with the situation in which all the tone generators have been assigned and an additional keyswitch is actuated.

Because there are ten fingers available to the musician, it would seem that ten tone generators would suffice for any keyboard. Modern keyboard electronic instruments have incorporated a tone effect that demands more than one tone generator to be assigned for a single finger. This tone effect is given the generic name of "sustain." Unfortunately this term has led to some confusion because the present terminology is to refer to an ADSR (attack/decay/sustain/release) time envelope modulation function. More properly the older term of "sustain" should now be called "long release". With a long release, it is a fairly easy matter to release a keyswitch and actuator another keyswitch with a single finger while the first tone generator is still operative and is automatically being reduced in tone volume by its ADSR envelope modulation function.

Several tone generator assignment logic systems have been disclosed which attempt to solve the availability problem. The inherent drawback with systems for assigning tone generators is that each of these systems has an assignment logic which is not ideal in the sense that one can readily postulate realistic musical playing techniques in which the assignment logic yields a result which may be contrary to the effect expected or desired by the musician.

A tone generator assignment system is disclosed in U.S. Pat. No. 3,610,806 entitled "Adaptive Sustain System For Digital Electronic Organ." In the disclosed system, a plurality of tone generators are provided each of which can be assigned to any keyswitch on any of the instrument's arrays of keyswitches. The long release mode is normally used on only one keyboard at a time. The adaptive sustain mode is entered only, and automatically, on the basis of internal information indicating (a) which tone generators have been committed to the keyboard demanding long release, (b) which of these tone generators that have been committed to a long release is producing a waveform envelope that has undergone the longest release time, and (c) which, if any, of the tone generators are idle and therefore available for assignment. However, as soon as all the tone generators have been assigned, the system automatically enters the adaptive sustain mode in which any tone generator assigned to a note associated with a key on the manual having a long release mode, and which generator is supplying the waveform that had had the longest duration of a release phase, is switched immediately from a long release to a relatively shorter release time. This action is purported to expedite the availability of a tone generator for assignment of the next note in a rapidly keyed sequence of notes.

One of the principal defects in assignment logic occurs when a long release time effort has been selected and the musician attempts to play a glissando by "dragging" a finger along the keyboard to quickly actuate a sequence of keyswitches. This quickly leads to a total assignment of all the available tone generators and then blank tones, or missing notes in the glissando sequence, occur until some of the older assigned tone generators completely finish their release phase of their ADSR envelope modulation function. At this time they can be reassigned but usually not before the blank tones have been encountered.

SUMMARY OF THE INVENTION

In a musical instrument having two sets of tone generators, a logic is implemented to borrow tone generators from the second set of tone generators to be temporarily used to augment the first set of tone generators. To prevent a rapid depletion of available tone generators, a logic is implemented to determine when a sequence of consecutive notes have been actuated within a prespecified time limit. If such a condition occurs, then a signal is generated which inhibits a long time release, or sustain, effect. The inhibit signal is automatically removed when the latest sequence of three notes is actuated with a time spacing greater than the prespecified time limit.

The first note in a sequence of notes starts a first counter which counts a source of timing signal. If the counter reaches its maximum count, it is reset and the decision is made that a glissando has not been initiated. If the first counter has not reached its maximum count, the actuation of a second note starts a second counter. If before a third note is actuated, the first counter reaches its maximum count, then the count state of the second counter is transferred to the first counter and the second counter is reset to zero. In this case the decision is made that a glissando has not been initiated. If the first counter and second counter have not reached their maximum count states before a third note is actuated, then the decision is made that a glissando has been initiated and an INHIBIT signal is generated which will temporarily prevent the use of a long release time, or sustain, effect.

A borrow logic is described in which members of a second set of tone generators can be temporarily made to act as if they were members of a first set of tone generators. The borrow action is implemented when the tone generator assignment subsystem finds that all the members of the first set of tone generators have been assigned to actuated keys and an additional demand for a tone generator is made by the actuation of a key to which a member of the first set of tone generators should be assigned. In this situation, if an unassigned tone generator exists in the second set of tone generators, it is temporarily made available to the first set of tone generators. After the associated keyswitch has been released, the borrowed tone generator is returned for its normal assignment status as a member of the second set of tone generators.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward the tone generator assignment in an electronic musical instrument to prevent the loss of tone production when all the available tone generators have been assigned and a new keyboard switch is actuated. The inventive assignment system includes a subsystem having logic which detects when a glissando has been initiated and uses that detection criterion to reduce a long release time that otherwise would rapidly cause a depletion of the available unassigned tone generators. A second assignment subsystem permits the temporary borrowing of unassigned tone generators nominally associated with a second keyboard when all the tone generators for the first keyboard have been assigned and a newly actuated keyswitch is detected.

Figure 1:
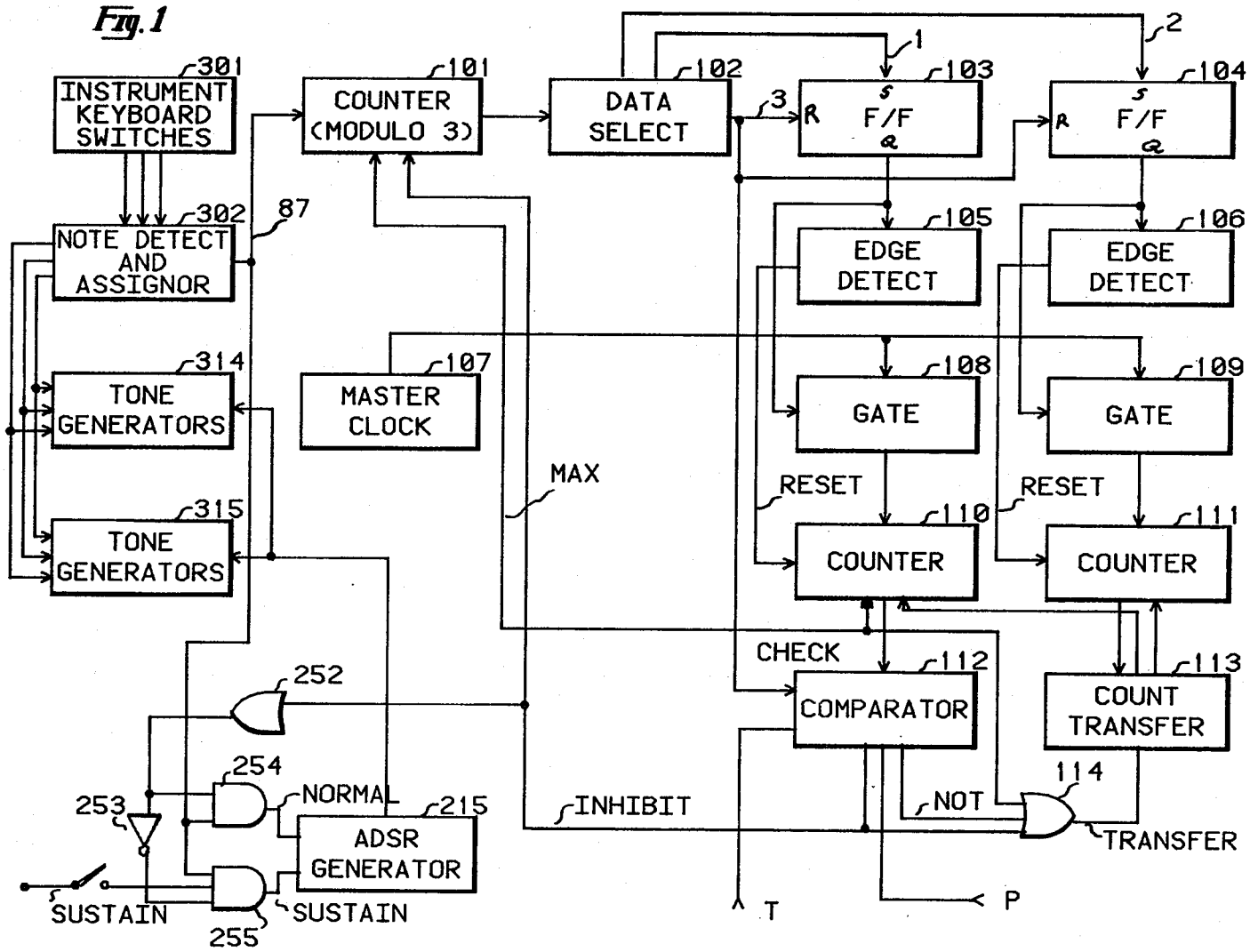
FIG. 1 is a schematic diagram of the glissando detection logic.

FIG. 1 illustrates an embodiment of the present invention which detects the initiation of a glissando. A glissando, for illustrative purpose, is defined as a sequence of three notes played in a time progression which is less than some first preassigned time interval and is greater than a second preassigned time interval. The glissando detect subsystem measures the time interval between the three most recently actuated keyswitches on a selected array of keyboard switches. If this time interval is less than the first preassigned time interval and is greater than the second preassigned time interval, then a signal is generated which is used to inhibit a long time release, or "sustain," effect for the tone generators which are assigned to the selected array of keyswitches. The first preassigned time interval is called the glissando decision time interval. The second preassigned time interval, as described below, is used to differentiate between a three note chord and the start of a glissando.

The instrument keyboard switches 301 contains a multiplicity of sets of keyboard switches arranged in arrays. Each set of keyswitches corresponds to a keyboard of the musical instrument. If one or more of the keyboard switches has a switch state change and is actuated ("on" switch position), the note detect and assignor 302 encodes the signal from the detected keyboard switch having the status change to an actuated state and stores the corresponding note information for the actuated keyswitches in a data memory.

A suitable note detect and assignor system is described in U.S. Pat. No. 4,022,098 which is hereby incorporated by reference.

As described in the referenced U.S. Pat. No. 4,022,098 the note detect and assignor 302 generates a binary logic "1" on line 87 when a keyswitch is detected to be in its actuated state and no tone generator in the tone generators contained in the system blocks labeled tone generators 314 and 315 have been assigned to that keyswitch.

To explain the system logic, it is assumed to counter 101 is initially in its minimal count state. This initialization is automatic as described later. The first time that a logic "1" signal appears on line 87, the counter 101 will be incremented to its one count state. In response to a state change in the content of the counter 101, the data select 102 will generate a pulse-like signal on one of its three output data lines. One of these lines is selected to transmit the pulse-like signal depending upon the count state of the counter 101. Each of the three lines is labeled with a number corresponding to the count state of counter 101.

When the counter 101 is incremented to its first count state, data select 102 transmits a signal on line 1 which sets the flip-flop 103. When flip-flop 103 is set, it output state Q becomes a binary logic "1" signal. When Q changes to its binary "1" state, the edge detect 105 generates a pulse-like signal which is used to reset the content of the counter 110 to its minimal count state.

In response to the state Q="1" from the flip-flop 103, the gate 108 transmits timing clock signals from the master clock 107 to the counter 110. These timing clock signals are used to increment the count states of the counter 110. If the counter 110 reaches its maximum count state and returns to its initial count state because of its modulo counting implementation, a MAX signal is generated. In response to the MAX signal, the counter 101 is reset to its initial count state.

The generation of the MAX signal implies that the time interval between a note and any note that may follow later in time is too large to decide that a glissando has been initiated. While various values of a decision time can be chosen, a value of three notes occuring in 0.25 seconds is one choice for the glissando decision criterion.

If another "1" signal appears on line 87 before the counter 110 has been incremented to its maximum count state, the counter 101 is incremented to its second count state. When the count 101 is incremented to its second count state, data select 102 transmits a pulse-like signal on line 2 which sets the flip-flop 104.

When the flip-flop 104 is set, its output state Q becomes a binary logic "1". In response to the state change to Q="1", the edge detect 106 creates a signal which initializes the content of the counter 111 to its minimum count state. At the same time, in response to the setting of flip-flop 104, the gate 109 allows timing signals from the master clock 107 to be transferred to be used to increment the count states of the counter 111.

If the counter 110 attains its maximum count state and then is reset because of its modulo counting implementation, a MAX signal is generated as described previously. The MAX signal is transmitted by OR-gate 114 to form a TRANSFER signal. In response to the TRANSFER signal, count transfer 113 transfers the count state of the counter 111 into the counter 110 and then causes the counts 111 to be reset to its minimal count state. This action will occur if the time interval between the first and second notes in a sequence of notes is larger than a predetermined time interval controlled by the length of time required by the master clock 107 to increment counter 110 to its maximum count. Therefore, if the TRANSFER signal is generated, the logic decision has been made that a glissando has not been initiated.

If the counter 101 succeeds in being incremented to its third count state, then there is a likelihood that a glissando has been initiated. If this event occurs, then the system logic acts to make a decision based upon the lapsed time interval between the actuation times of the first and third keyswitch closure in a sequence of three consecutive keyswitch closures or actuations. This corresponds to two pairs of consecutive keyswitch closures in which the second element of the first pair is the same as the first element of the second pair.

In response to the counter 101 being incremented to its third count state, the data select 102 creates a pulse-like CHECK signal on the output signal line 3. In response to the creation of the CHECK signal in its binary "1" logic state, both flip-flops 103 and 104 are reset thereby "freezing" the contents of the counter 110 and the counter 111.

When comparator 112 receives the "1" logic state for the CHECK signal, it compares the count state C of the counter 110 with a prespecified constant P. P is a constant that is supplied to the comparator as a system operation parameter. If C is greater than or equal to P, the decision is made that a glissando sequence has not been initiated and a NOT signal is created with a binary "1" logic state. In response to a "1" state for the NOT signal, OR-gate 114 generates the TRANSFER signal. The creation of the TRANSFER, as described previously causes a transfer of the count state of counter 111 to the counter 110 and then causes the initialization of the counter 111.

If the comparator 112 finds that the count state of counter 110 is less than P but greater than a threshold value T, an INHIBIT signal is generated. The generation of the INHIBIT signal as a "1" binary logic state signifies that the decision has been reached that a glissando sequence of notes has been initiated.

The INHIBIT signal is used by the OR-gate 114 to generate the TRANSFER signal which, as previously described, transfers the count state of counter 111 to the counter 110 and resets the state of counter 111 to its minimum value. The INHIBIT signal also causes the counter 101 to be set to its second count state so that the glissando logic detect system is made ready to determine if the detected glissando is continued or has ended.

The threshold number T provided to the comparator 112 is used to differentiate between a glissando sequence of consecutive notes and a chord in which each of the notes are not played simultaneously such that there is a slight time delay between the actuation of the component notes of the chord. T can be selected to correspond to a time interval of about 0.08 seconds.

The INHIBIT signal is transferred by the OR-gate 252 to the AND-gate 254. The signal on line 87 will have a "1" state, therefore a NORMAL signal is generated by the AND-gate 254. The NORMAL signal causes the ADSR generator 251 to generate a "normal" relese time phase for the assigned tone generators. This action is caused by the inverter gate 253 which acts to inhibit a SUSTAIN action signal produced by the AND-gate 255. The SUSTAIN, or long release ADSR envelope modulation phase, is initiated by closing the SUSTAIN switch.

The ADSR generator 251 can be implemented in the manner described in U.S. Pat. No. 4,079,650 entitled "ADSR Envelope Generator." This patent is hereby incorporated by reference.

A second feature of the inventive system is a method of borrowing non-assigned tone generators from a second set of tone generators when all the tone generators in the first set have been assigned and a new keyswitch is detected as having been actuated. Although the glissando detect subsystem acts to reduce the likelihood of all the tone generators in the first set from being assigned, the complete assignment of all tone generators can still occur.

The inventive concept is illustrated for a musical instrument system in which the first keyboard array of keyswitches corresponds to the upper manual of an organ while the second keyboard array of keyswitches corresponds to the lower manual. This illustrative system does not imply any restriction or limitation of the invention which is readily implemented to include borrowing of tone generators from any combination of instrument keyboards.

Figure 2:
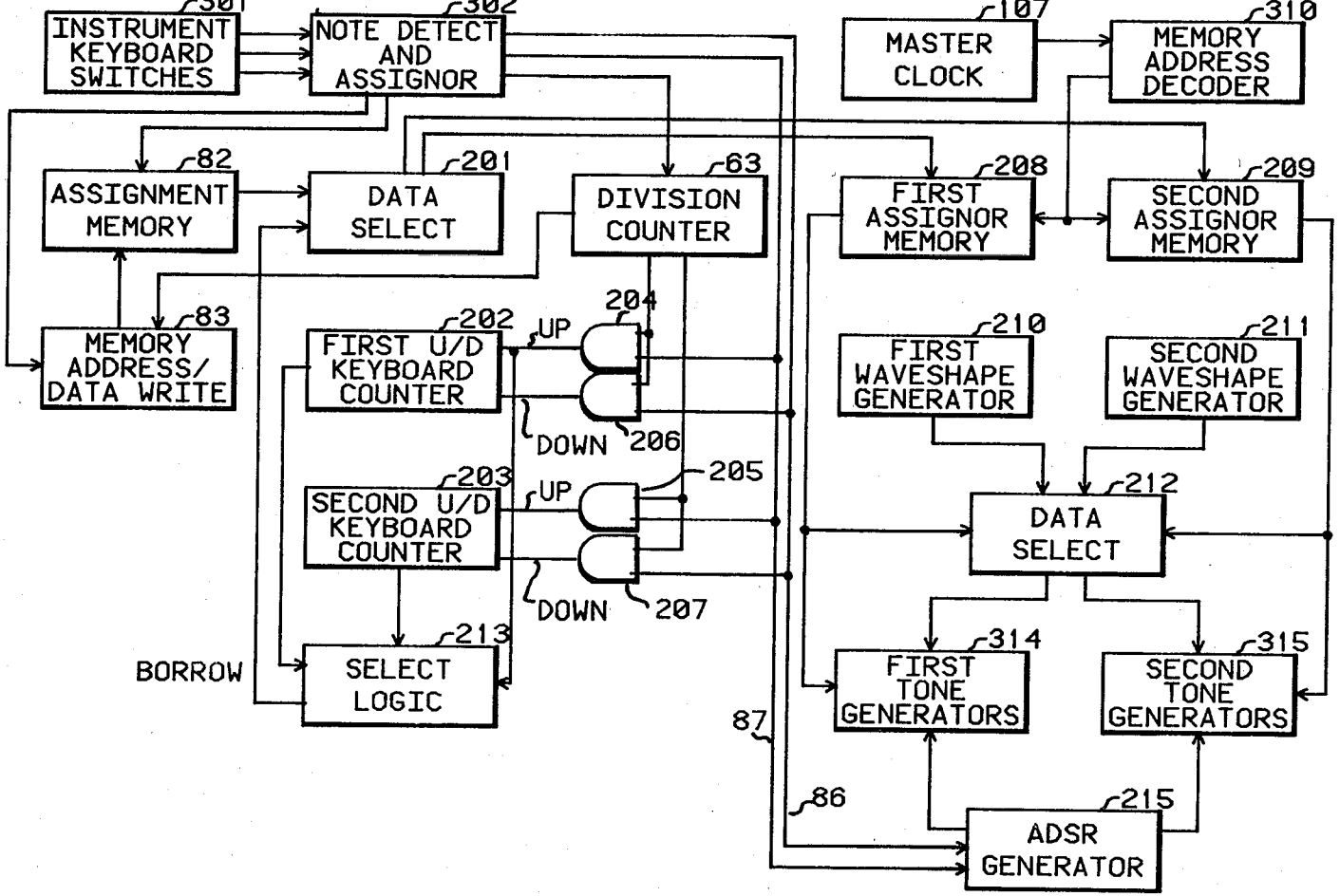
FIG. 2 is a schematic diagram of the tone generator borrowing logic.

FIG. 2 illustrates the subsystem logic for the temporary borrowing of tone generators from a second set of tone generators for assignment to keyswitches nominally associated with a first set of tone generators.

The assignment memory 82, the memory address-/data write 83, and the division counter 63 are components of the note detect and assignor 302. Their function is described in the referenced U.S. Pat. No. 4,022,098. These system blocks have the same numerical labels as those shown in the patent.

The first tone generators 314 are a set of tone generators of number N and are dedicated for assignment to keyswitches actuated on the first keyboard array of keyswitches. A second set of tone generators are contained in the system logic block labeled second tone generators 315. The second set of tone generatores are nominally dedicated for assignment to keyswitches actuated on the second keyboard array of keyswitches. However, in the manner described below, elements of the second set of tone generators can be assigned, on a demand basis, to actuated keyswitches on the first keyboard array of keyswitches.

As described in the referenced U.S. Pat. No. 4,022,098, the assignment memory 82 contains a number of assignment data words each of which corresponds to one of the available tone generators in the combination collection of the first and second sets of tone generators. Each assignment data word is encoded to include (a) assignment status of a tone generator assigned or non-assigned, (b) keyboard array identification (upper, lower, pedal), (c) octave number within which the actuated keyswitch belongs, and (d) musical note number within the octave.

The assignment data words are read out of the assignment memory 82 in response to address signals provided by the memory address/data write 83. The read out assignment data words are transmitted to the data select 201. The data select 201 includes a decoder for decoding the keyboard identification designation which was encoded into the assignment data word.

The division counter 63 is a component of the note detect and assignor. Its function is described in the referenced U.S. Pat. No. 4,022,098 where it is shown with the same numerical label in FIG. 2. The count state of the division counter 63 controls which of the plurality of arrays of keyboard switches is currently being searched to ascertain the status of its keyswitch states.

The assignment memory 82 is partitioned so that a number of K1 memory addresses are reserved for storing assignment data words corresponding to the first set of tone generatores and a number of K2 memory addresses are reserved for storing assignment data words corresponding to the second set of tone generators.

The data select 201 transmits the assignment data words read out from the assignment memory 82 to either the first assignor memory 208 or to the second assignor memory 209. The selection between the first or second assignor memory is determined by the data select 201 in response to the keyboard array identification number which is decoded by the data select 201 for each assignment data word read out from the assignment memory 201. An assignment data word will be sent to the first assignor memory 208 if its keyboard array identification number corresponds to the upper, or first, array of keyboard switches. The assignment data word will be sent to the second assignor memory 209 if its keyboard array identification number corresponds to the lower, or second, array of keyboard switches.

If the BORROW signal from the select logic 213 is in its "1" binary logic state, the data select 201 will transmit an assignment data word to the first assignor memory 208 if its keyboard identification number corresponds to the first array of keyboard switches. When the BORROW signal is in the "1" state, the data select 201 decodes both the keyboard identification number and the assignment status number. If the keyboard identification number corresponds to the second array of keyboard switches and the assignment status number is a "1", indicating an assigned tone generator condition, the assignment data word is transferred to the second assignor memory 209. If the keyboard identification number corresponds to the second array of keyboard switches and the assignment status number is as "0", indicating an unassigned tone generator condition, the assignment data word is transferred to the second assignor memory 208 and is encoded to indicate a borrowed status. As described, below this second condition causes the temporary borrowing of a tone generator from the second set of tone generators to provide an additional member of the first set of tone generators. When an assignment data word is "borrowed" it is encoded with a number that indicates that it is a "borrowed" assignment data word.

As described in the referenced U.S. Pat. No. 4,022,098 a "1" binary logic state signal appears on line 87 from the note detect and assignor 302 if a newly actuated keyswitch had been detected on any of the arrays of keyboard switches and if an unassigned assignment data word is found in the assignment memory 82. A "1" binary logic state signal appears on line 86 if a previously detected keyswitch closure is found to have changed state and has been released ("off" condition).

An UP signal is generated by the AND-gate 204 if a "1" signal appears on line 87 while the state of the division counter 63 corresponds to a detection scan of the first keyboard array of keyswitches. In response to the UP signal, the first up-down keyboard counter 202 is incremented. A DOWN signal is generated by the AND-gate 206 if a "1" signal appears on line 86 while the state of the division counter 63 corresponds to a detection scan of the first keyboard array of keyswitches. In response to the DOWN signal, the first up-down keyboard counter 202 is decremented. The net result is that the count state of the first U/D keyboard counter 202 corresponds to the number of currently actuated keyswitches on the first keyboard to which elements of the first set of tone generators have been assigned.

A similar arrangement to that described above results in the count state of the second U/D keyboard counter 203 having a count state corresponding to the number of currently actuated keyswitches on the second keyboard to which elements of the second set of tone generators have been assigned.

The first U/D keyboard counter 202 is implemented to have a maximum count of K1 corresponding to the number of tone generators in the first set of tone generators. The second U/D keyboard counter 203 is implemented to have a maximum count of K2 corresponding to the number of tone generators in the second set of tone generators. These counters are not implemented to count modulo their maximum or minimum count states. When the maximum count state is attained, a further increment will not change the count state. Similarly if the minimum count state is attained, a further decrement will not change the count state.

The select logic 213 contains a comparator which compares the count states of the first U/D keyboard counter 202 and the count state of the second U/D keyboard counter 203. A "1" state is generated for the BORROW signal if the first U/D keyboard counter 202 is at its maximum count state of K1, if the second U/D keyboard counter 203 is not at its maximum count state of K2, and if an UP signal has been generated by the AND-gate 204. These conditions correspond to all elements of the first set of tone generators having been assigned, a new demand to assign a tone generator to the first keyboard, and a currently unassigned tone generator in the second set of tone generators.

The assignment data words are read out of the first assignor memory 208 and are read out of the second assignor memory 209 by means of the memory address decoder 310. The memory address decoder 310 is cycled through the memory address locations by signals provided by the master clock 107. The assignment data words read out of the first assignor memory 208 are used to assign tone generators in the first tone generators 314 (first set of tone generators) to actuated keyswitches on the first keyboard. The assignment data words read out of the second assignor memory 209 are used to assign tone generators in the second tone generators 315 (second set of tone generators) to actuated keyswitches on the second keyboard.

The first waveshape generator 210 creates the waveshape data that are converted into musical tones by the assigned members of the first tone generators 314. The second wave shape generator 211 creates the waveshape data that are converted into musical tones by the assigned members of the second tone generators 315. Apparatus for generating waveshape data to be converted into musical tones is described in U.S. Pat. No. 4,085,644 entitled "Polyphonic Tone Synthesizer." This patent is hereby incorporated by reference.

In response to an assignment data word read out from the first assignor memory, data select 212 transfers waveshape data from the first waveshape generator to one of the tone generators in the first tone generators 314 which corresponds to the assignment data word.

If an assignment data word read out from the second assignor memory 209 has not been encoded to indicate a "borrow" status, data select 212 transfers waveshape data from the second waveshape generator 211 to one of the tone generators in the second tone generators 315 which corresponds to the assignment data word. If an assignment data word read out from the second assignor memory 209 has been encoded to indicate a "borrow" status, data select transfers waveshape data from the first waveshape generator 210 to one of the tone generators in the second tone generators 215 which corresponds to the assignment data word. In this fashion, a tone generator in the second tone generators 215 has been "borrowed" to temporarily act as if it were an element of the first tone generators 314.

The ADSR generator 215 generates envelope modulation functions for the tone generators to create the attack/decay/sustain/release phases of a musical tone. This attack phase is initiated in response to a signal on line 87 and the release phase is initiated in response to a signal on line 86. Apparatus to implement the ADSR generator 215 is described in U.S. Pat. No. 4,079,650 entitled "ADSR Envelope Generator". This patent is hereby incorporated by reference.

In the fashion described, the net result is that when all of the tone generators in the first tone generators 314 have been assigned to actuated keys on the first keyboard, additional key actuations on this keyboard will borrow tone generators from the second tone generators 315. It is noted that as soon as the borrowed tone generators are released, they are made available for normal assignment to actuated keyswitches on the second keyboard. This action is the result of not encoding the "borrowed" status information on the assignment data words stored in the assignment memory 82 but only the assignment data words which are copied into the second assignor memory 209 for temporary storage.

Figure 3:
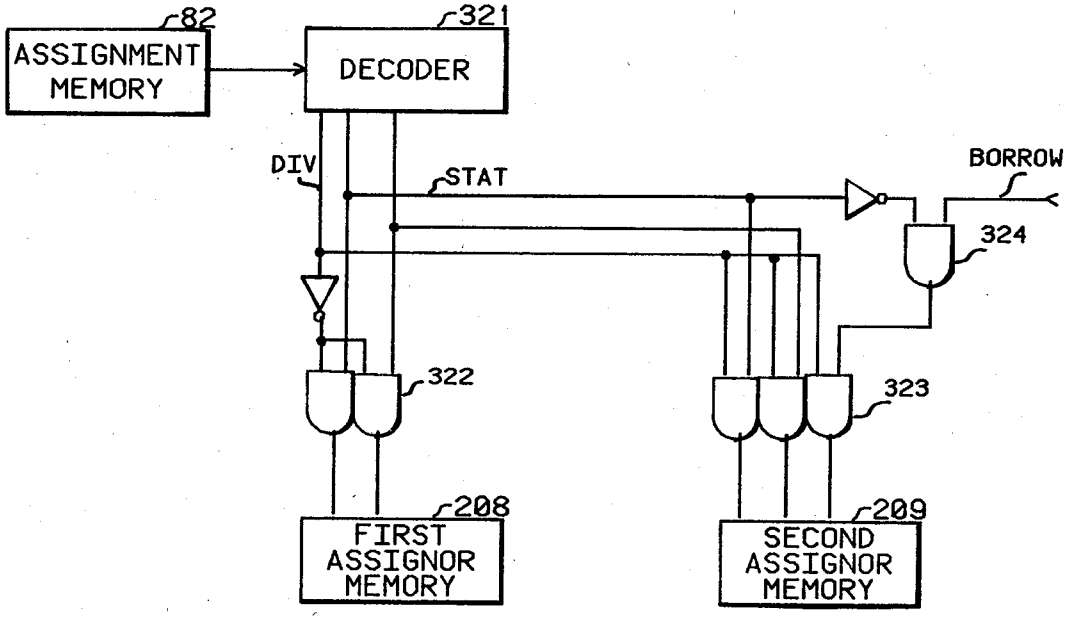
FIG. 3 is a schematic diagram of the data select 201.

FIG. 3 is a schematic diagram showing the details of the data select 201. The elements having labels in the 300 series comprise the data select 201. The decoder 321 decodes an assignment data word read out of the assignment memory on to a set of output signals. Only three such lines are shown explicitly in the figures. These are the division signal, assignment status, and the remaining lines are drawn symbolically as a single line to simplify the drawing. With two sets of keyboard arrays of switches, the DIV (division) signal has the binary logic state of "0" for the first keyboard and "1" for the second keyboard. The division counter 63 also has the same two binary logic states.

When the assignment data word has a "0" state for the division code, then the decoded data word from the decoder 321 is transferred by means of the set of AND-gates 322 to be stored in the first assignor memory 208. When the division code has a "1" state, then the decoded data word from the decoder 321 is transferred by means of the set of AND-gates 323 to be stored in the second assignor memory 209.

The STAT (tone generator assignment status) signal has a "0" binary logic state if the corresponding tone generator is not assigned and has a "1" binary logic state if the corresponding tone generator has been assigned.

If an unassigned status is found after an assignment data word associated with the second keyboard and if the BORROW signal has its "1" logic state, then AND-gate 324 will generate the borrow signal data which is combined with the assignment data word stored in the second assignor memory 209.

I claim:

1. In combination with a keyboard musical instrument comprising a first and a second keyboard array of keyswitches and comprising a first and a second plurality of tone generators for generating musical tones, apparatus for assigning members of said first and second plurality of tone generators to actuated keyswitches comprising:

a keyswitch state detect means wherein a detect signal is generated in response to each actuated keyswitch in said first and in said second keyboard array of keyswitches, an encoding means for encoding each said detect signal to generate a detect data word which identifies the corresponding actuated keyswitch and its associated keyboard array of keyswitches, an assignor means responsive to said detect data word whereby one of said first plurality of tone generators is assigned to generate a musical tone associated with said first keyboard array of keyswitches if said detect data word identifies an actuated keyswitch on said first keyboard array of keyswitches and whereby one of said second plurality of tone generators is assigned to generate a musical tone associated with said second keyboard array of keyswitches if said detect data word identifies an actuated keyswitch on said second keyboard array of keyswitches, a first envelope modulation function generator for scaling the amplitudes of musical tones generated by assigned ones of said first plurality of tone generators wherein in response to a first sustain mode signal musical tones having a long release phase are generated, a second envelope modulation function generator for scaling the amplitudes of musical tones generated by assigned ones of said second plurality of tone generators wherein in response to a second sustain mode signal musical tones having a long release phase are generated, a sustain mode means wherein said first sustain mode signal and said second sustain mode signals are created, a note sequence timing detect means responsive to each said detect signal whereby a first inhibit signal is generated if a sequence of a prespecified number of detect data words encoded to identify actuated keyswitches on said first keyboard array of keyswitches occurs in a time interval less than a prespecified time interval and whereby a second inhibit signal is generated if said prespecified sequence of detect data words encoded to identify actuated keyswitches on said second keyboard array of keyswitches occurs in a time interval less than said prespecified time interval, a release time control means whereby in response to said first inhibit signal said first sustain mode signal is not provided to said first envelope modulation function generator and whereby in response to said second inhibit signal said second sustain mode signal is not provided to said second envelope modulation function generator, and a borrow assignor means interposed between said assignor means and said first and second plurality of tone generators whereby select ones of said second plurality of second tone generators are caused to generate musical tones corresponding to musical tones generated by said first plurality of tone generators.

2. In a musical instrument according to claim 1 wherein said note sequence timing detect means comprises;

an interval timer means responsive to each said detect data word in said prespecified sequence of detect data words whereby a time interval is measured between each pair of consecutive detect signals encoded to identify keyswitches actuated on said first keyboard array of keyswitches, and an inhibit signal generator means whereby said first inhibit signal is generated if the sum of said time interval measured between a said pair of consecutive detect signals added to a time interval measured between a subsequent pair of consecutive detect signals is equal to a sum time interval which is less than said prespecified time interval.

3. In a musical instrument according to claim 2 wherein said interval timer means comprises, a clock means for providing timing signals, a first interval counter means for counting said timing signals modulo a specified number M and wherein a first reset signal is generated when said first interval counter means returns to its minimal count state, a second interval counter means for counting said timing signals, a consecutive counter means incremented by each detect signal in said sequence of detect signals wherein said consecutive counter means counts modulo three, a count reset means whereby the content of said first interval counter is reset to its minimal count state when the count state of said consecutive counter means is incremented to its minimal value and whereby the content of said second interval counter means is reset to its minimal value when the count state of said consecutive counter means is incremented to its first count state greater than said minimal value, a first gating means whereby said timing signals are provided to increment the count state of said first interval counter if said consecutive counter means has been incremented to either a count state of value one or of value two, a second gating means whereby said timing signals are provided to increment the count state of said second interval counter if said consecutive counter means has been incremented to a count state of value two, and a comparator means whereby in response to a count state of value three for said consecutive counter means the count state of said first interval counter is compared with a prespecified threshold number and whereby a said inhibit signal is generated if said threshold number is greater in value than the count state of said first interval counter.

4. In a musical instrument according to claim 3 wherein said first interval timer means further comprises;

a maximum count generator wherein a maximum signal is generated when said first interval counter is incremented to a prespecified maximum count state, a reset means whereby said consecutive counter means is reset to its minimal count state in response to said maximum signal, and a count transfer means whereby in response to said maximum signal the count state of said second interval counter means is transferred to said first interval counter means and said second interval counter means is reset to its minimum count state.

5. In a musical instrument according to claim 4 wherein said count transfer means further comprises:

transfer circuitry whereby in response to said inhibit signal the count state of said second interval counter means is transferred to said first interval counter means and said second interval counter means is reset to its minimum count state.

6. In a musical instrument according to claim 1 wherein said borrow assignor means comprises:

a first tone generator counter means responsive to each said detect data word whereby the count state of said first tone generator counter means corresponds to the number of said first plurality of tone generators assigned to actuated keyswitches on said first keyboard array of keyswitches, a second tone generator counter means responsive to each said detect data word whereby the count state of said second tone generator counter means corresponds to the number of said second plurality of tone generators assigned to actuated keyswitches on said second keyboard array of keyswitches, borrow encoding means whereby if said first tone generator counter means has attained its maximum count state and if said second tone generator counter means has not attained its maximum count state a borrow signal is generated in response to a detect data word encoded to correspond to a newly actuated keyswitch contained in said first keyyboard array of keyswitches, and a borrow asignor means whereby in response to said borrow signal one of said second plurality of second tone generators is caused to generate a musical tone corresponding to musical tones generated by said first plurality of tone generators.

7. In combination with a keyboard musical instrument comprising a keyboard array of keyswitches, apparatus for detecting a sequence of a prespecified number of consecutive notes actuated within a prespecified time interval comprising:

a keyswitch state detect means wherein a detect signal is generated in response to each actuated keyswitch in said keyboard array of keyswitches thereby creating a sequence of consecutive time signals each one of which comprises one said detect signal, a plurality of tone generators each of which generates a musical tone, an assignor means responsive to said detect signal whereby one of said plurality of tone generators is assigned to generate a musical tone corresponding to said actuated keyswitch associated with said detect signal, a note sequence timing detect means responsive to said consecutive time signals wherein a glissando detect signal is generated if a prespecified number of said sequence of consecutive time signals is generated in a time interval less than said first prespecified time interval and greater than a second prespecified time interval, and a utilization means responsive to said glissando detect signal.

8. In a musical instrument according to claim 7 wherein said note sequence timing detect means comprises;

an interval timer means responsive to each detect signal in said prespecified sequence of detect signals whereby a time interval is measured between each consecutive pair of consecutive time signals and wherein each said consecutive pair of time signals comprises a detect signal common to each said pair of time signals, and a comparator means whereby said glissando detect signal is generated if the sum of time intervals between two said consecutive pairs of detect signals is less in value than said first prespecified time interval and is greater in value than said second prespecified time interval.

9. In combination with a keyboard musical instrument comprising a keyboard array of keyswitches, apparatus for detecting a consecutive sequence of notes actuated within a prespecified time interval comprising;

a keyswitch state detect means wherein a detect signal is generated in response to each actuated keyswitch in said keyboard array of keyswitches thereby creating a sequence of consecutive time signals each one of which comprises one said detect signals, a plurality of tone generators each of which generates a musical tone, an assignor means responsive to said detect signal whereby one of said plurality of tone generators is assigned to generate a musical tone corresponding to said actuated keyswitch associated with said detect signal, a note sequence timing detect means responsive to said consecutive time signals wherein a glissando detect signal is generated if a prespecified number of said sequence of consecutive time signals is generated in a time interval less than said first prespecified time interval and greater than a second prespecified time interval, an envelope modulation function generator for scaling the amplitudes of musical tones generated by assigned ones of said plurality of tone generators, a sustain means responsive to a sustain signal whereby said envelope moduation function generator creates a long time release scaling function in response to the deactuation of a keyswitch on said array of keyboard switches, and a sustain inhibit means interposed between said sustain means and said plurality of tone generators whereby in response to said glissando detect signal said sustain signal is inhibited and not provided to said sustain means.

* * * * *